US005965345A

United States Patent [19]

Link et al.

[11] Patent Number: 5,965,345

[45] **Date of Patent: *Oct. 12, 1999**

[54] CO-DISPERSION OF SENSITIZING DYES

[75] Inventors: Steven George Link, Rochester; John William Boettcher, Webster; Frederick Charles Derks; Heidi Melissa Viterise, both of Rochester, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/571,017

[22] Filed: Dec. 12, 1995

[51] Int. Cl.[6] ..... G03C 1/005

[52] U.S. Cl. ..... 430/574; 430/572; 430/573; 430/575; 430/576; 430/577; 430/585

[58] Field of Search ..... 430/574, 585, 430/572, 573, 575, 576, 577

[56] References Cited

U.S. PATENT DOCUMENTS

| | | | |
|---|---|---|---|
| 3,469,987 | 9/1969 | Owens et al. | 430/569 |
| 3,850,645 | 11/1974 | Herz et al. | 96/114.7 |
| 4,040,839 | 8/1977 | Matsuyama et al. | 430/574 |
| 4,040,841 | 8/1977 | Hinata et al. | 430/574 |
| 4,582,786 | 4/1986 | Ikeda et al. | 430/577 |
| 4,607,005 | 8/1986 | Urata | 430/574 |
| 5,298,389 | 3/1994 | Possanza et al. | 430/569 |
| 5,376,523 | 12/1994 | Henry et al. | 430/572 |
| 5,508,162 | 4/1996 | Dankosh | 430/574 |

FOREIGN PATENT DOCUMENTS

| | | | |
|---|---|---|---|
| 0082649 | 6/1983 | European Pat. Off. | 430/574 |
| 0 658 805 | 6/1995 | European Pat. Off. . | |
| 0 666 497 | 8/1995 | European Pat. Off. . | |
| 93/23792 | 11/1993 | WIPO . | |

*Primary Examiner*—Thorl Chea
*Attorney, Agent, or Firm*—Edith A. Rice

[57] ABSTRACT

A method of sensitizing a silver halide emulsion comprises the steps of:

a) forming a co-dispersion of a first sensitizing dye and a second sensitizing dye in an aqueous medium, wherein the peak absorptance of the second dye is at least 10 nm different from the peak absorptance of the first dye, and wherein the ratio of the first dye to the second dye is from about 0.1 to 20; and b) incorporating the resulting co-dispersion in a silver halide emulsion.

11 Claims, 6 Drawing Sheets

CO-DISPERSION OF SENSITIZING DYES

FIELD OF THE INVENTION

This invention concerns a method for the addition of sensitizing dyes to a silver halide emulsion that provides for an intimate mixture of adsorbed dyes on the surface of the silver halide particles, avoids the use of organic solvents and reduces variability.

BACKGROUND OF THE INVENTION

In conventional photography, silver halide particles are used to capture incident radiation and form a latent image. The latent image is later amplified in a development step. However, silver halide is only sensitive to ultraviolet and blue radiation. Therefore, to capture images in color the silver halide must be made sensitive to other wavelengths of visible light. This is normally accomplished by adding a spectral sensitizing dye. The dye can be added at different times during the preparation of the silver halide emulsion, chemical sensitization, or spectral sensitization process. The dye can be added in many different ways, as a solution in water or an organic solvent, as a gelatin dispersion, or as a suspension of microcrystalline particles. It is frequently necessary to use a combination of more than one dye to adjust the wavelength where the emulsion absorbs the maximum amount of light, or to control some other property of the emulsion. This is particularly true for J-aggregating cyanine dyes (where several dye molecules interact in such a way as to cause a shift in the absorption of light to longer wavelengths with a very narrow absorption band). J-aggregating dyes are preferred in many cases for their narrow absorption and high extinction.

When using more than one dye, the timing of the addition of the dyes can be very important. Also, the order in which the dyes are added often makes a difference in the final distribution of light-absorbing molecules on the emulsion surface. With J-aggregating cyanine dyes, the most desirable state in most three-color photographic applications is to have the two dyes intimately mixed on the surface so that the mixture absorbs light as a single aggregate, not like the two individual dyes. This can sometimes be very difficult to achieve if the dyes have a tendency to strongly adsorb as separate J-aggregates.

The common practice in manufacturing is to add the two dyes separately with a waiting period in between to allow the dye to equilibrate onto the surface of the silver halide particles. This method often leads to variability when the emulsion is prepared in different batch sizes, because the addition time and mixing are varying. Another concern in the practice of spectral sensitization of photographic silver halide emulsions is to use methods in manufacture that are efficient and environmentally benign. The use of organic solvents in manufacture is undesirable because the solvents can be released to the atmosphere as they evaporate out of the coated film. Aqueous dispersions with or without gelatin are preferred because they do not use volatile solvents.

PROBLEM TO BE SOLVED BY THE INVENTION

When using a combination of more than one cyanine dye to achieve a particular desired spectral sensitization effect, the result obtained has a strong dependence on the order of addition of the dyes and the time between the addition of the dyes. Indeed, it has been found that when using separate dispersions of sensitizing dyes, the results obtained were quite variable, depending on the timing of the addition of the two dyes. The desired result of intimate mixing of the two dyes, obtained by the use of an organic solvent, was not achievable by the use of separate dye dispersions.

SUMMARY OF THE INVENTION

We have found a method of achieving the desired mixture of adsorbed J-aggregating dyes which reduces the time needed for spectrally sensitizing an emulsion for manufacture, is environmentally benign, and is invariant with timing of dye addition.

One aspect of this invention comprises a method of sensitizing a silver halide emulsion by:

a) forming a co-dispersion of a first sensitizing dye and a second sensitizing dye in an aqueous medium, wherein the peak absorptance of the second dye is at least 10 nm different from the peak absorptance of the first dye, and wherein the ratio of the first dye to the second dye is about 10:1 to 1:20; and b) incorporating the resulting co-dispersion in a silver halide emulsion.

The term "absorptance" as used in this patent application, including the claims, means the amount of light absorbed by the dye when it is adsorbed to the silver halide grains of the emulsion to be sensitized.

ADVANTAGEOUS EFFECT OF THE INVENTION

The dyes are added simultaneously by the method of this invention and co-adsorb to the silver halide surface, producing a highly invariant intimate mixture of dyes that absorbs light as a single aggregate at an intermediate wavelength. The simultaneous addition of the dyes in this fashion avoids organic solvents and reduces the time necessary for manufacture, because there is no need to wait between the addition of a first and second dye.

DETAILED DESCRIPTION OF THE INVENTION

Figure 1:
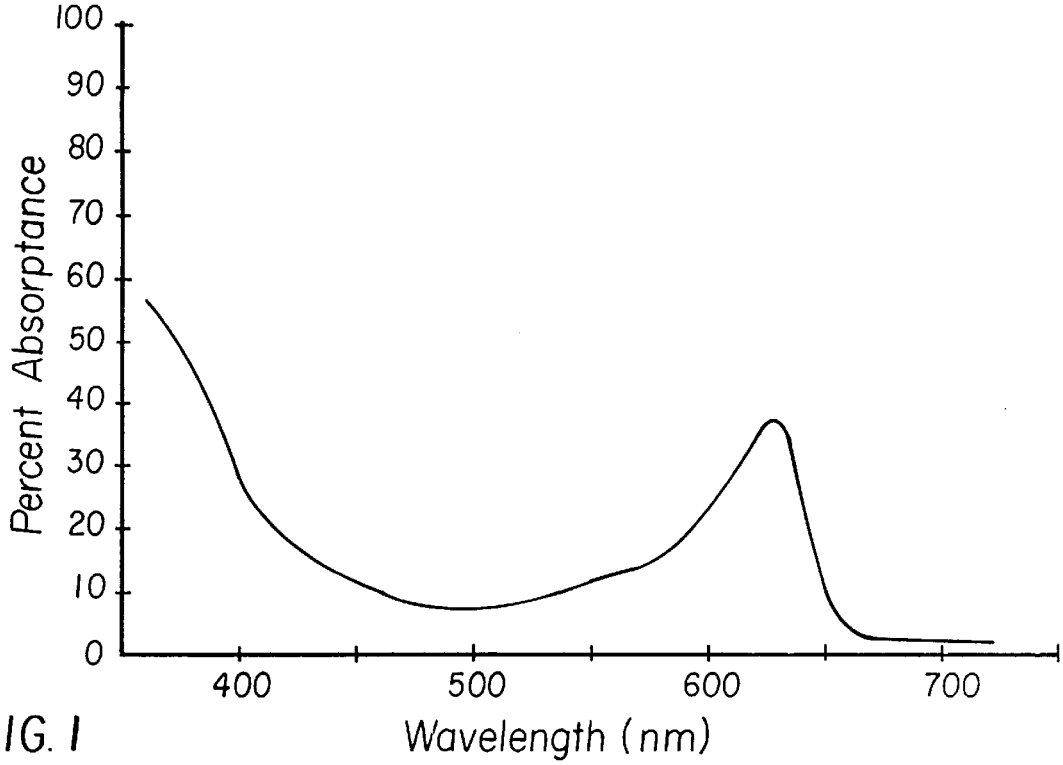
FIGS. 1–11 are graphs showing percent absorptance at various wavelengths of light for dye co-dispersions of this invention and comparison dispersions as set forth in Examples 3–5 below.

In accordance with this invention a silver halide emulsion is sensitized using a co-dispersion of two J-aggregating sensitizing dyes, the first sensitizing dye having a peak absorptance at least 10 nm different from (i.e., either 10 nm greater than or 10 nm less than) the peak absorptance of the second dye. The co-dispersion optionally can contain one or more additional sensitizing dyes. The co-dispersion can be prepared by either of two methods. In the first method, powdered samples of each of the dry solid dyes are added to a rapidly stirred aqueous medium to form a homogeneous co-dispersion of both dyes. The aqueous medium can be water or a solution of water and a hydrophilic colloid, such as gelatin. The powdered dyes can be added simultaneously or, preferably sequentially. The temperature during the addition and agitation of the dyes is preferably from about 20° to about 50° C., more preferably about 25° to about 40° C. If desired, the temperature during the addition stage can be different from the temperature during the agitation stage. For example, the dyes can be added at about 20° C. and then the temperature raised to about 40° C. while the agitation continues. Agitation is generally continued for a period of 30 minutes to 5 hours, preferably from about 30 minutes to about 3 hours.

The second method comprises forming separate dispersions of each of the dyes. The first dye is added to a rapidly stirred aqueous medium and agitated to form a first homogeneous dispersion. The second dye is added to a different rapidly stirred aqueous medium to form a second homogeneous dispersion. In each case the time and temperature of addition and agitation is as set forth above for the direct co-dispersion method. The dispersions can be cooled (if necessary) and stored until needed. To form the co-dispersion of the two dyes, the first and second homogeneous dispersions are heated, if necessary, and mixed together with mild agitation.

In the dispersion forming methods, the composition can be mixed or agitated by any suitable means using any suitable device including magnetically driven stirring bars of various shapes and motor driven shaft stirrers of the propeller or Cowles type. J. Y. Oldshue in "Fluid Mixing Technology", McGraw-Hill New York, 1983, p. 50, provides the following formula which can be used to calculate the preferred amount of agitation to be used:

$$p/\text{kg}=(\text{diameter})^5\times(\text{RPM})^3/\text{Batch size}$$

wherein Diameter=diameter of Cowles or other blade in inches and Batch size=the weight of the batch in kilograms (kg). Best results in terms of minimizing the number of undispersed dye particles can be obtained when p/kg >50×$10^9$.

The first method set forth above is preferred because only one dispersion making process is necessary. Gelatin dispersions of sensitizing dyes are known and are described in published world patent application WO-93223792 and in JP-05/297496. The co-dispersions of sensitizing dyes disclosed in these references adsorb at the same wavelength, i.e., their absorptancies are substantially the same. Applicants have discovered that the use of co-dispersions of J-aggregating sensitizing dyes with different peak absorptancies co-aggregate when used to sensitize silver halide emulsion to give a single intermediate peak absorptance.

J-aggregating cyanine dyes can be described by general formula I:

(I)

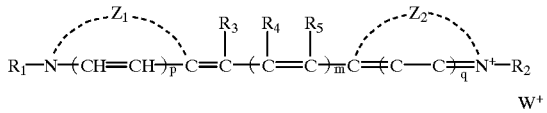

where $Z_1$ and $Z_2$ represent the atoms necessary to form a substituted or unsubstituted hetero ring and may be the same or different, m, p, and q may be 0 or 1, $R_1$ and $R_2$ are acid solubilizing groups, $R_3$, $R_4$, and $R_5$ are each hydrogen or 1–4 carbon alkyl groups and $W^+$ is a counterion as needed to balance the charge. When m is 0 $R_3$ is preferably hydrogen. Examples of hetero rings represented by $Z_1$ and $Z_2$ include oxazole, benzoxazole, naphthoxazole (e.g. naphth[1,2-d]oxazole, naphth[2,3-d]oxazole, 8,9-dihydronaphth[1,2-d]oxazole), thiazole, benzothiazole, naphththothiazole, selenazole, benzoselenazole, naphthoselenazole, benzimidazole, naphthimidazole, or quinoline. The rings may be substituted by one or more substituents, such as hydroxy, halogen, unsubstituted or substituted 1 or 2 carbon alkyl (e.g. methyl, ethyl, trifluoromethyl), unsubstituted or substituted aryl, heteroaryl (e.g. thienyl, furanyl, 1-pyrrolyl, 2-pyrrolyl), alkoxy group of 1–2 carbon atoms, alkylthio groups of 1–2 carbon atoms, carboxy, alkoxycarbonyl of 2–4 carbon atoms, acylamino of 2–4 carbon atoms, methylenedioxy, cyano, acyl of 2–4 carbon atoms, unsubstituted or substituted benzoyl, alkylsulfonyl of 1–2 carbon atoms, unsubstituted or substituted arylsulfonyl, unsubstituted or substituted carbamoyl. Examples of acid solubilizing groups represented by $R_1$ and $R_2$ are: carboxymethyl, carboxyethyl, carboxypropyl, phosphonopropyl, phosphonobutyl, sulfatoethyl, thiosulfatopropyl, and preferably sulfoalkyl groups such as sulfoethyl, sulfopropyl, 3-sulfobutyl, 4-sulfobutyl, 2-hydroxy-3-sulfopropyl, and sulfoethylcarbamoylmethyl. It is recognized that anionic dyes are usually isolated as salts of the acid substituents. Common counterions are sodium, potassium, triethylammonium (TEA+), tetramethylguanidinium (TMG+), diisopropylammonium (DIPA+), and tetrabutylammonium (TBA+).

Examples of J-aggregating cyanine dyes that can be formulated as co-dispersions according to this invention are shown below.

Dye 1
J-agg = 650 nm

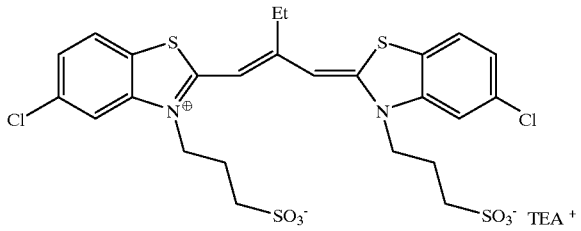

Dye 2
J-agg = 610 nm

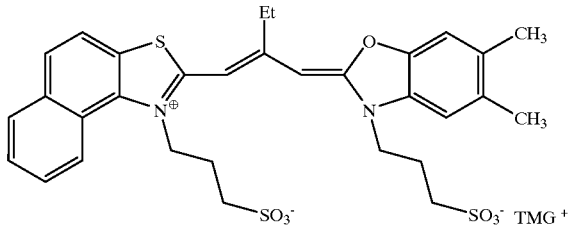

-continued
Dye 3
J-agg = 610 nm
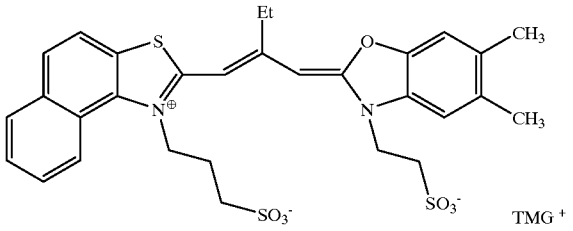
Dye 4
J-agg = 640 nm
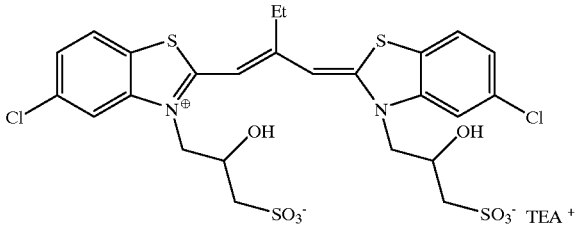
Dye 5
J-agg = 641
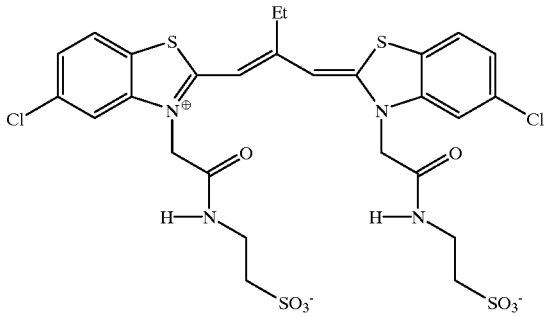
Dye 6
J-agg = 600 nm
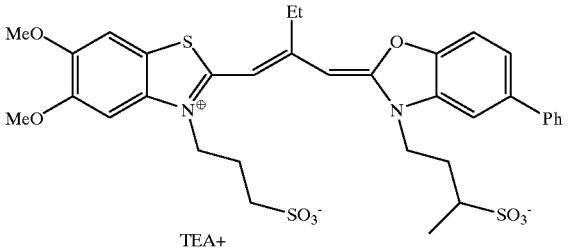
Dye 7
J-agg = 567 nm
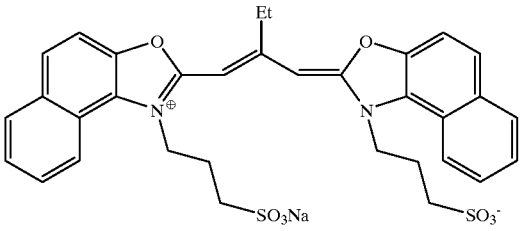
Dye 8
J-agg = 545 nm
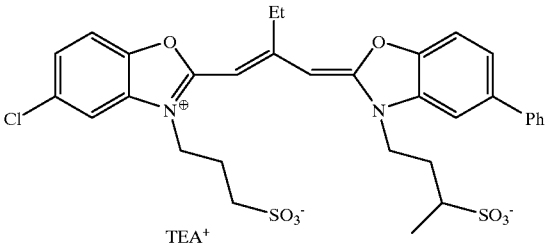

-continued

Dye 9
J-agg = 550 nm

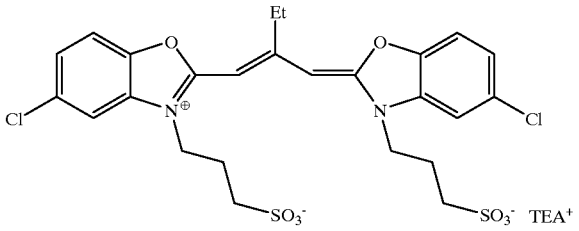

Dye 10
J-agg = 570 nm

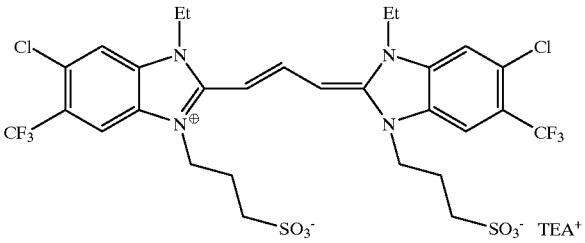

Dye 11
J-agg = 570 nm

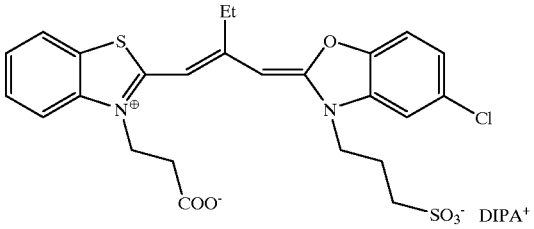

Dye 12
J-agg = 468 nm

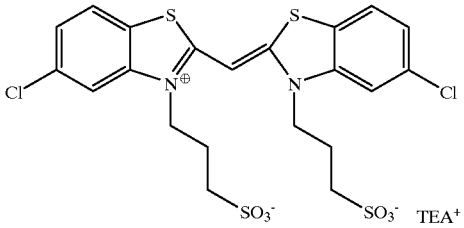

Dye 13
J-agg = 472 nm

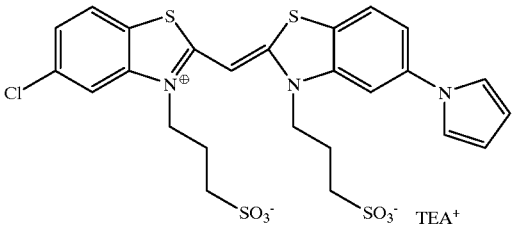

Dye 14
J-agg = 440 nm

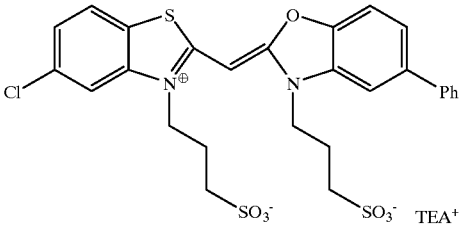

According to the invention, two or more dyes whose J-aggregate peaks are separated by at least 10 nm can be co-dispersed, for example, dye 1 and dye 2, dye 1 and dye 3, dye 4 and dye 6, dye 5 and dye 6, dye 1, dye 3 and dye 11, dye 7 and dye 8, dye 8 and dye 10, dye 9 and dye 11, dye 12 and dye 14, dye 13 and dye 14.

In this patent application reference will be made to Research Disclosure, September 1994, Number 365, Item 36544, which will be identified hereafter by the term "Research Disclosure I". The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The dyes may be added to an emulsion of the silver halide grains and a hydrophilic colloid at any time prior to (e.g., during or after chemical sensitization) or simultaneous with the coating of the emulsion on a photographic element. In accordance with this invention, the dyes are added to the silver halide emulsion as a codispersion of the dyes in an aqueous medium. The dye/silver halide emulsion may be mixed with a dispersion of color image-forming coupler immediately before coating or in advance of coating (for example, 2 hours).

The amount of sensitizing dye that is useful in the invention is preferably in the range of 0.1 to 4.0 millimoles per mole of silver halide and more preferably from 0.2 to 2.2 millimoles per mole of silver halide. Optimum dye concentrations can be determined by methods known in the art. These dyes can be used in combination with other dyes to obtain desired light absorption profiles, and can be used on a variety of emulsions.

The silver halide used in the photographic elements may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t >8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure* I and James, *The Theory of the Photoaraphic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein. The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as described in *Research Disclosure I*, Section IV (pages 510–511) and the references cited therein.

The sensitized silver halide emulsions prepared using the co-dispersions of this invention can be used to prepare a photographic element, preferably, a multicolor element. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements may also usefully include a magnetic recording material as described in Research Disclosure, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements having one or more light sensitive layers in which the silver halide have been sensitized in accordance with the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

The silver halide emulsions employed in photographic elements may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V of *Research Disclosure I*, referred to above. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

Photographic elements may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530, 272; Japanese Application A-113935; U.S. Pat. No. 4,070, 191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019, 492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148, 022; 3,148,062; 3,227,554; 3,384,657; 3,379,529; 3,615, 506; 3,617,291; 3,620,746; 3,701,783; 3,733,201; 4,049, 455; 4,095,984; 4,126,459; 4,149,886; 4,150,228; 4,211, 562; 4,248,962; 4,259,437; 4,362,878; 4,409,323; 4,477, 563; 4,782,012; 4,962,018; 4,500,634; 4,579,816; 4,607, 004; 4,618,571; 4,678,739; 4,746,600; 4,746,601; 4,791, 049; 4,857,447; 4,865,959; 4,880,342; 4,886,736; 4,937, 179; 4,946,767; 4,948,716; 4,952,485; 4,956,269; 4,959, 299; 4,966,835; 4,985,336 as well as in patent publications GB 1,560,240; GB 2,007,662; GB 2,032,914; GB 2,099, 167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540, 653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No.

5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

EXAMPLE 1

PREPARATION OF A GELATIN CO-DISPERSION

A 2" Cowles blade on a stainless steel shaft and connected to a G. K. Heller motor controller was set 1.5" from the bottom of an approximately 5" diameter stainless steel container. Distilled water (922 g) and deionized gelatin (60 g) were placed in the container in a 50° C. constant temperature bath. The stirrer speed was adjusted to maintain a vortex to the blade. Dye 2 (10 g which had been passed through a 1 mm sieve) was added over a period of 2.5 min. Dye 1 (4.62 g which had been passed through a 1 mm sieve) was then added over 1 min 10 sec. Stirring was maintained for 60 min at a rate of 1830 rpm. The resulting co-dispersion was 1% by weight Dye 2 and 0.46% by weight Dye 1. It had a purple color and was very viscous.

EXAMPLE 2

PREPARATION OF AN AOUEOUS NON-GELATIN DISPERSION

A 2" Cowles blade on a stainless steel shaft and connected to a Lightning air mixer was set 1.5" from the bottom of a an approximate 7" diameter stainless steel container. High purity water (2949.15 g) was placed in the container at room temperature. To the water was added a diluted solution of Rohm-Haas Kathon LX microbiocide, to give 15 ppm biocide in the final dispersion. The stirrer speed was adjusted to maintain a vortex to the blade. Dye 3 (30 g) was added over a period of 3 minutes. Dye 1 (14.43 g) was added over a 2 minute period. Stirring was maintained for a period of 30 minutes at about 1800 rpm. The resulting non-gel co-dispersion was nominally 1% by weight Dye 3 and 0.481% by weight Dye 1. It was purple in color and very viscous. For chemical stability the dispersion was made 0.0025 M in sodium propionate.

EXAMPLE 3

SPECTRAL SENSITIZATION OF A TABULAR EMULSION

An iodobromide tabular emulsion (1.44 micron by 0.12 micron, 4.1% iodide) was chemically and spectrally sensitized as sample 3-1 by the following procedure: at 40° C., 100 mg/mole Ag NaSCN, hold 15 min, 35 mg/mole Ag 3-methylsulfonylcarbamoylethyl benzothiazolium fluoroborate, hold 2 min, 0.289 mmole/mole Ag dye 1 and 0.577 mmole/mole Ag dye as a common solution in methanol, hold 20 min, 2.13 mg/mole Ag sodium aurous dithiosulfate, 0.868 mg/mole Ag sodium thiosulfate pentahydrate, heat 5 degrees/3 minutes to 66° C., hold 5 min, cool 5 degrees/3 minutes to 40° C. Sample 3-2 was prepared identically except that dye 3 and dye 1 were added as separate solutions in methanol with a 10 min hold in between. Sample 3-3 was prepared as sample 3-2 except that the dye 1 was added as a 1.0% by weight gelatin dispersion with a 10 min hold, followed by dye 1 as a 1.5% by weight gelatin dispersion with a 10 min hold. Sample 3-4 was prepared as sample 3-1 except that a co-dispersion of dyes 1 and 3 prepared as in Example 1 was used.

Figure 2:
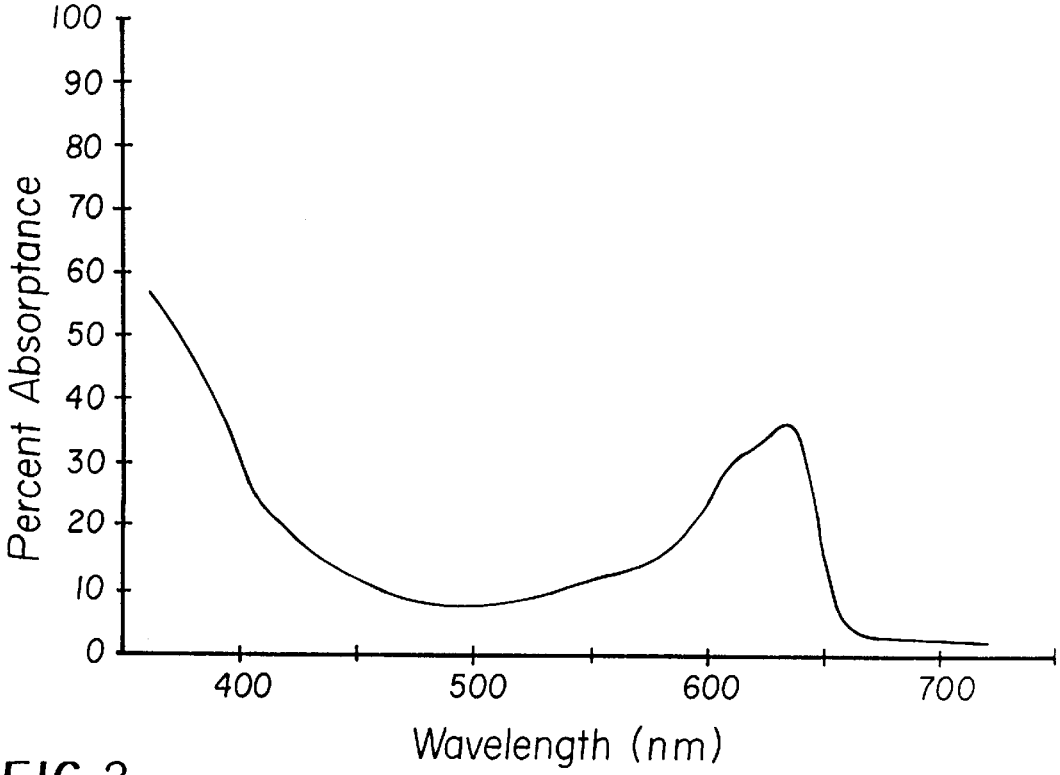
Figure 3:
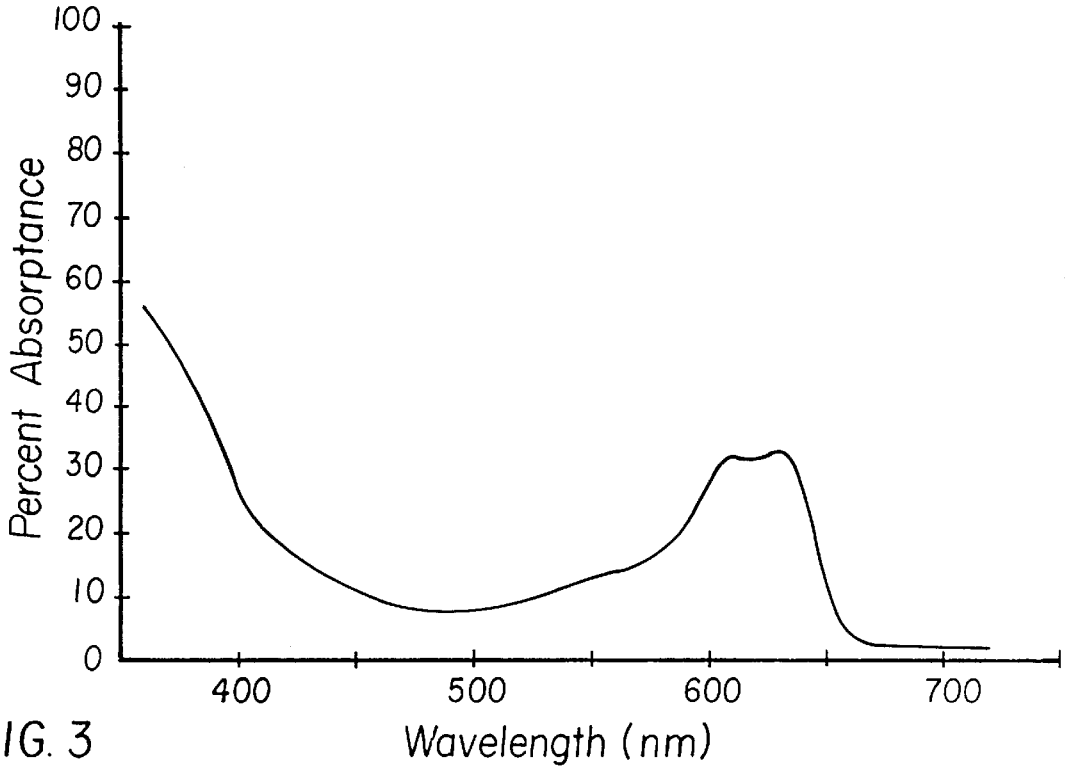
Figure 4:
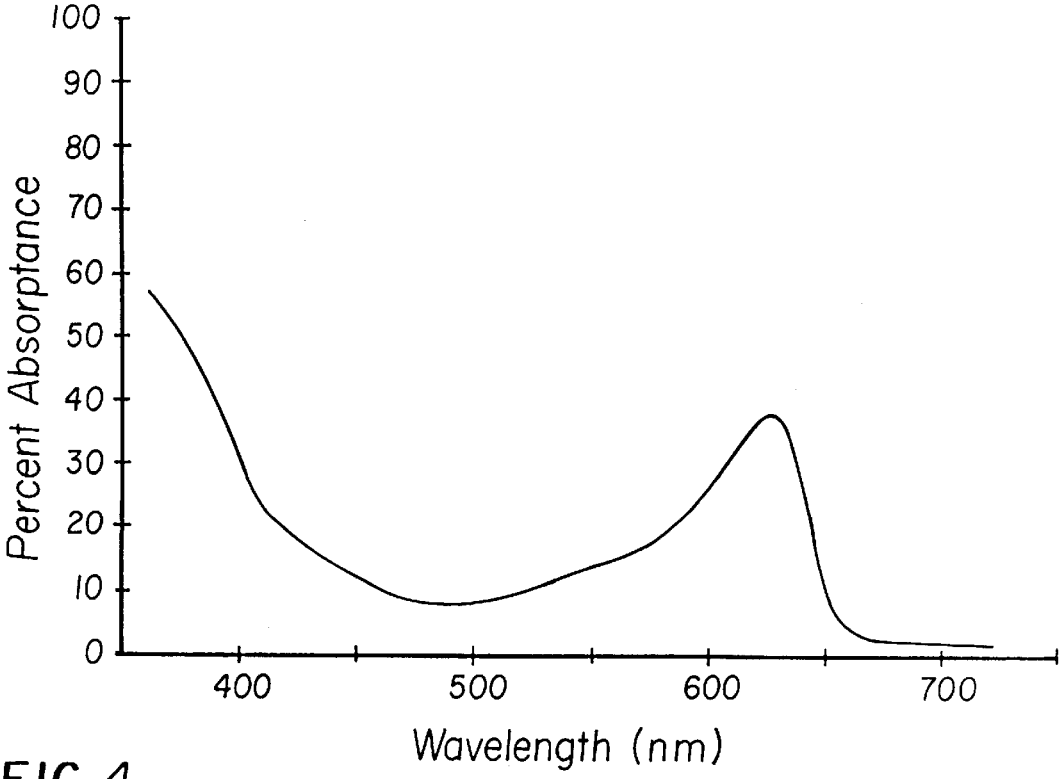
Figure 5:
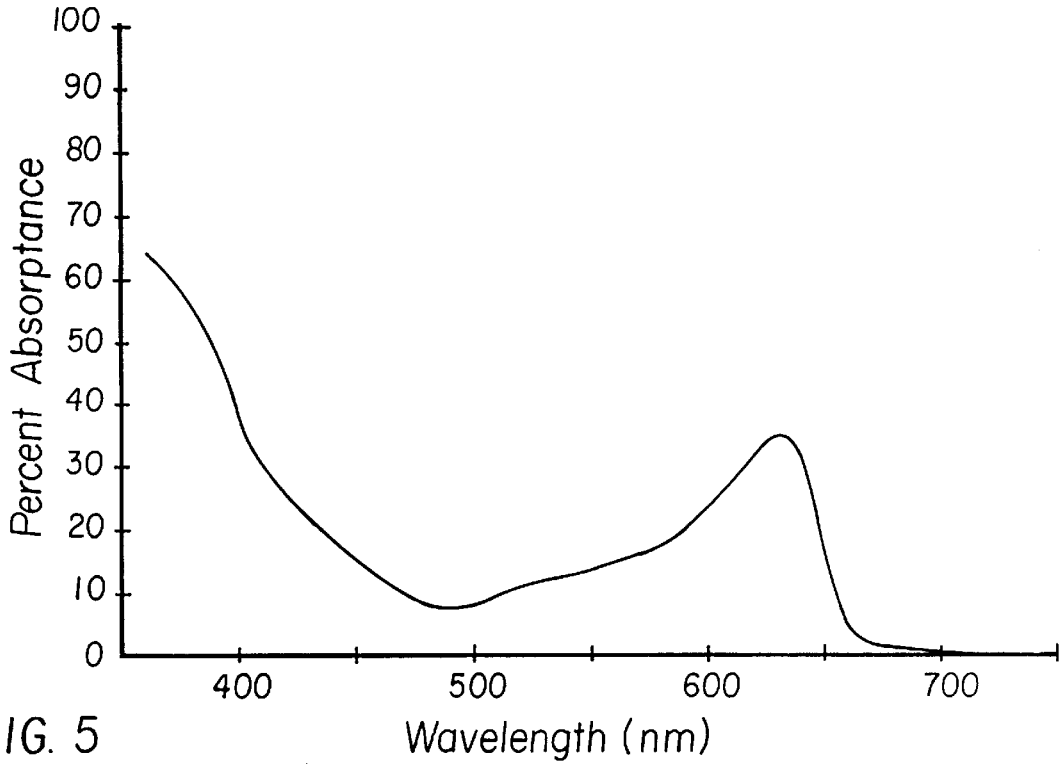
Figure 6:
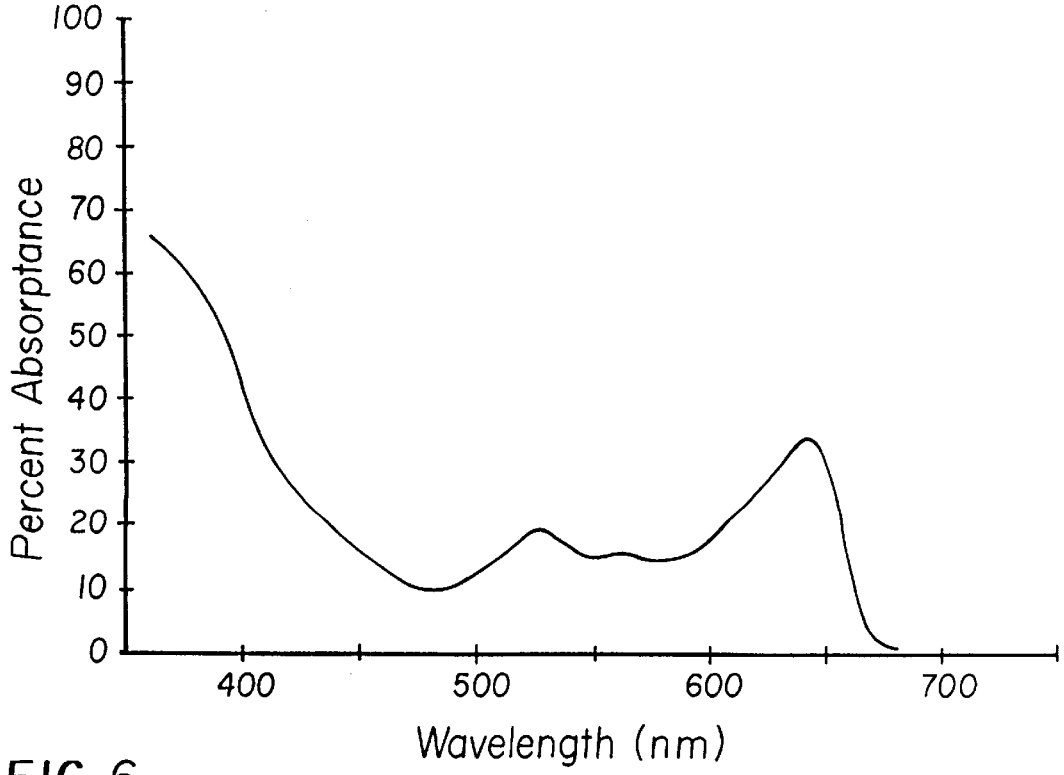
Figure 7:
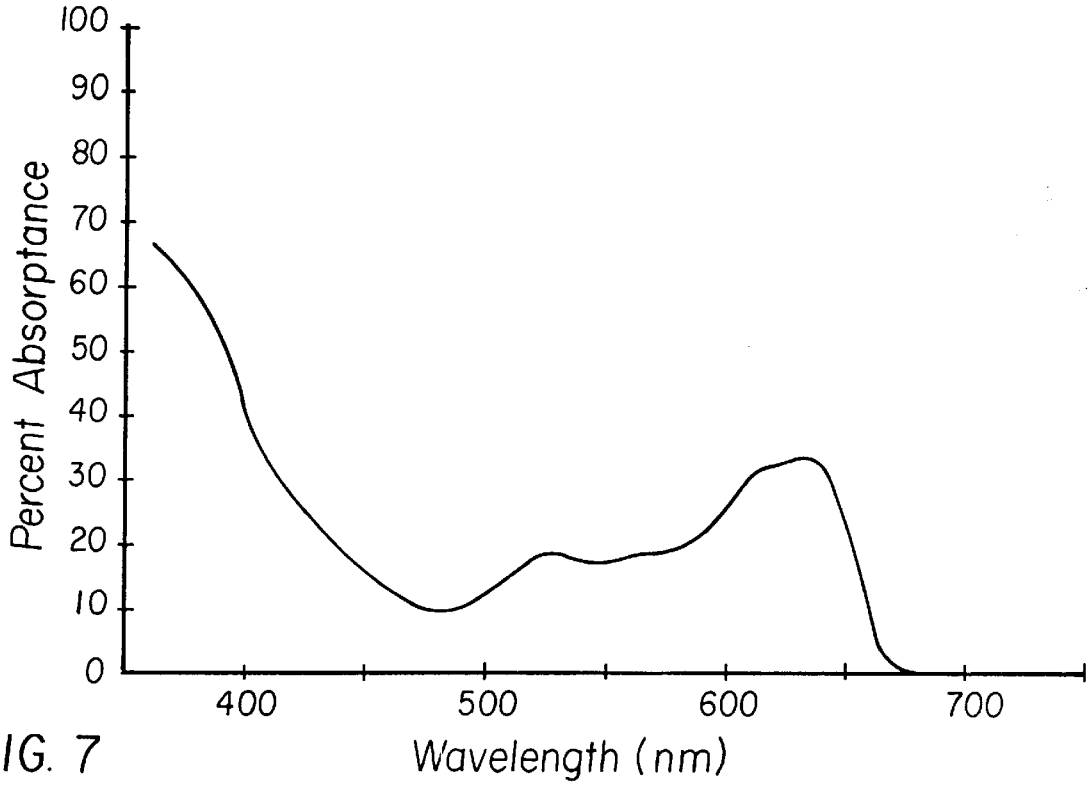
Figure 8:
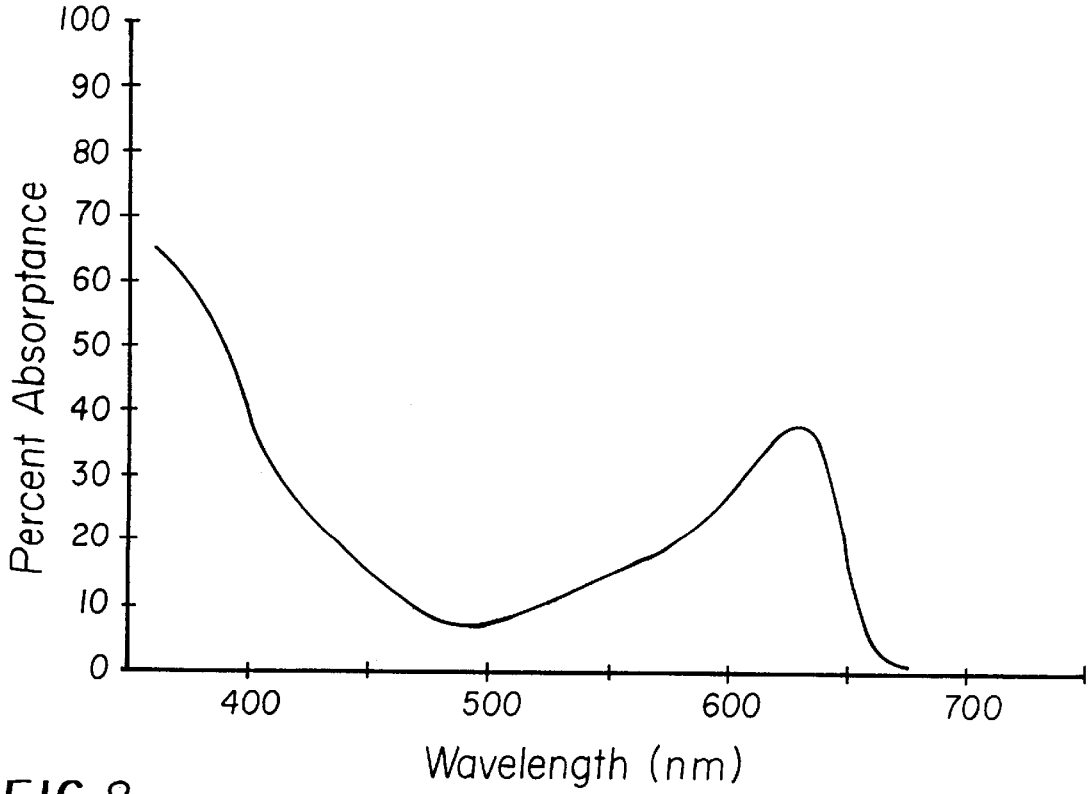

The chemically and spectrally sensitized emulsions were then coated on a cellulose acetate support at a level of 0.83g/$m^2$ Ag, 1.05 g/$m^2$ of cyan coupler 1, 0.043 g/$m^2$ coupler 2, and 0.043 g/$m^2$ coupler 3 and 1 g/mole Ag of tetraazaindene. The coated samples were analyzed spectrophotometrically by placing a piece of the coating inside an integrating sphere and determining the total amount of light absorbed by the dyed emulsion as a function of wavelength. The results are shown in FIGS. 1–4. FIG. 1 shows a single peak corresponding to a co-aggregate of the two dyes (sample 3-1), but the use of methanol to achieve this is undesirable. FIGS. 2 and 3 show that a single co-aggregate is not achieved when the dyes are added separately (samples 3-2 and 3-3 respectively). Finally, FIG. 4 shows that the co-aggregate can be achieved without the use of methanol solvent when the dyes are co-dispersed according to the invention (sample 3-4).

Cyan coupler 1

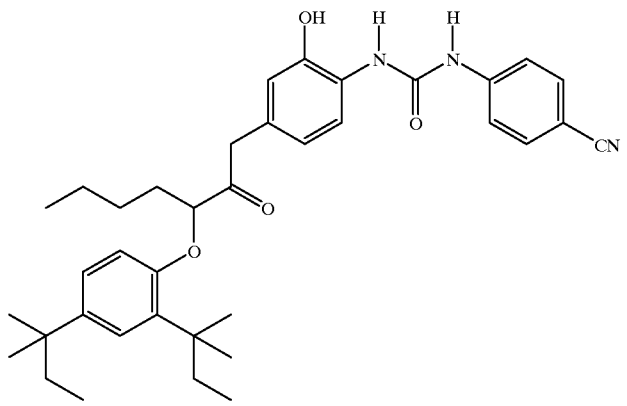

-continued

Coupler 2

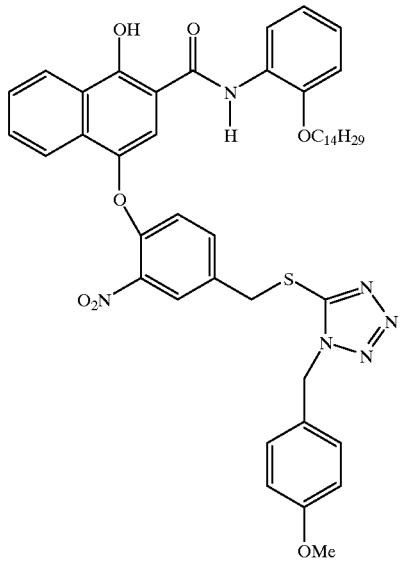

Coupler 3

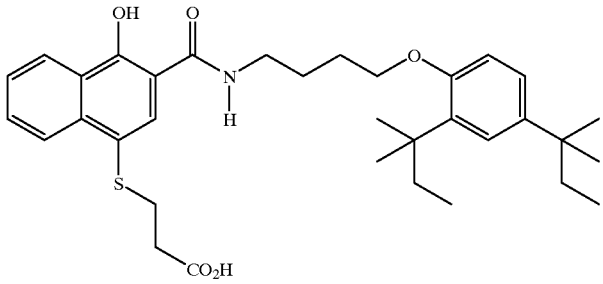

EXAMPLE 4

SPECTRAL SENSITIZATION OF A CUBIC EMULSION

An iodobromide cubic emulsion (0.39 micron edge length, 3.3% iodide) was chemically and spectrally sensitized as sample 4-1 by the following procedure: at 40° C., 0.200 mmole/mole Ag dye 1 and 0.400 mmole/mole Ag dye 3 as a common solution in methanol, hold 20 min, 6.0 mg/mole Ag sodium aurous dithiosulfate, 3.0 mg/mole Ag sodium thiosulfate pentahydrate, heat 5 degrees/3 minutes to 61° C., hold 5 min, cool 5 degrees/3 minutes to 40° C. Sample 4-2 was prepared identically except that dye 3 and dye 1 were added as separate solutions in methanol with a 10 min hold in between. Sample 4-3 was prepared as sample 4-2 except that dye 3 was added as a 1.0% by weight gelatin dispersion with a 10 min hold, followed by dye 1 as a 1.5% by weight gelatin dispersion with a 10 min hold. Sample 4-4 was prepared as sample 4-1 except that a co-dispersion of dyes 1 and 3 prepared as in Example 1 was used.

The chemically and spectrally sensitized emulsions were coated and analyzed exactly as in Example 3. The results are shown in FIGS. 5–8. In this case, even sample 4-1 using dyes mixed in methanol, shows unaggregated dye at 520 nm (arrow in FIG. 5). Sample 4-2 and 4-3, with the dyes added separately shows (in FIGS. 6 and 7 respectively) many different aggregation states for the dyes. Only sample 4-4, with the dyes added according to the invention, shows (in FIG. 8) a single co-aggregate peak.

EXAMPLE 5

SPECTRAL SENSITIZATION OF A TABULAR EMULSION

An iodobromide tabular emulsion (1.53 micron by 0.12 micron, 4.1% iodide) was chemically and spectrally sensitized as sample 5-1 by the following procedure: at 40° C., 100 mg/mole Ag NaSCN, hold 15 min, 35 mg/mole Ag 3-methylsulfonylcarbamoylethyl benzothiazolium fluoroborate, hold 2 min, 0.562 mmole/mole Ag dye 3 as a 0.5% by weight gelatin dispersion with a 10 min hold, 0.281 mmole/mole Ag dye 1 as a 1.5% by weight gelatin dispersion with a 10 min hold, 2.13 mg/mole Ag sodium aurous dithiosulfate, 0.868 mg/mole Ag sodium thiosulfate pentahydrate, heat 5°/3 minutes to 70° C., hold 5 min, cool 5°/3 minutes to 40° C. Sample 5-2 was prepared identically except that the single dye dispersions of dyes 1 and 3 were co-dispersed by melting together before addition to the emulsion followed by a 20 min hold. Sample 5-3 was prepared as sample 5-2 except that a co-dispersion of dyes 1 and 3 prepared as in Example 1 was used.

Figure 9:
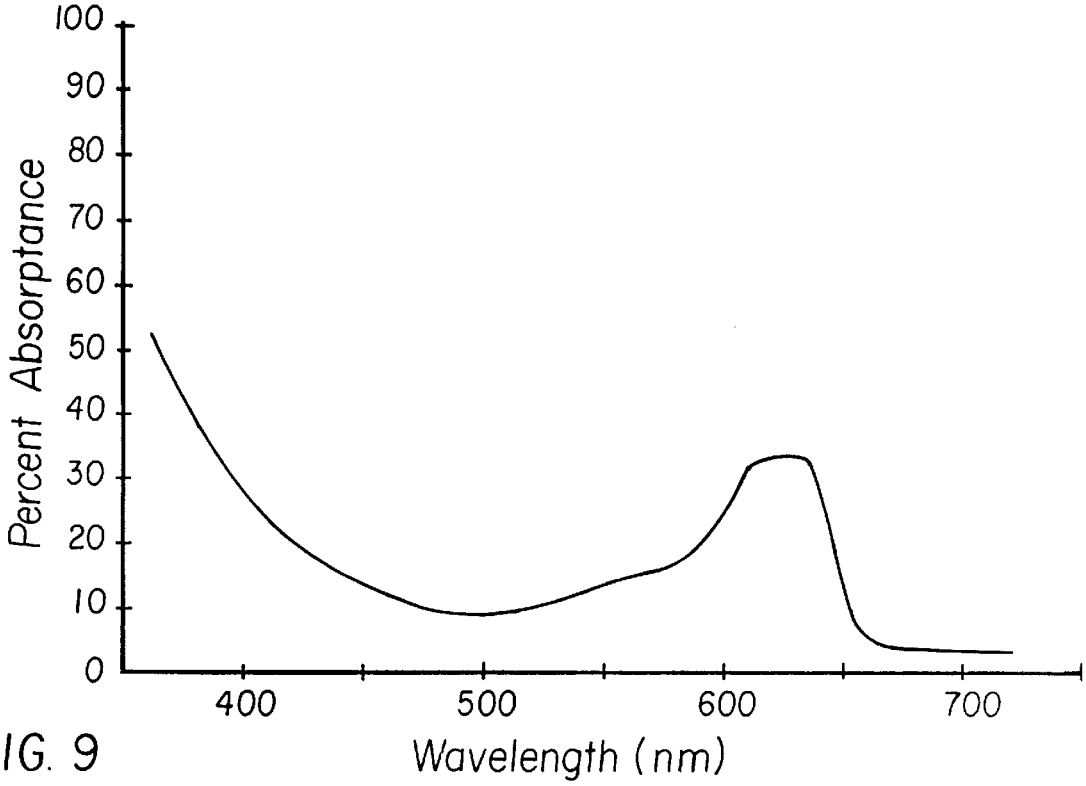
Figure 10:
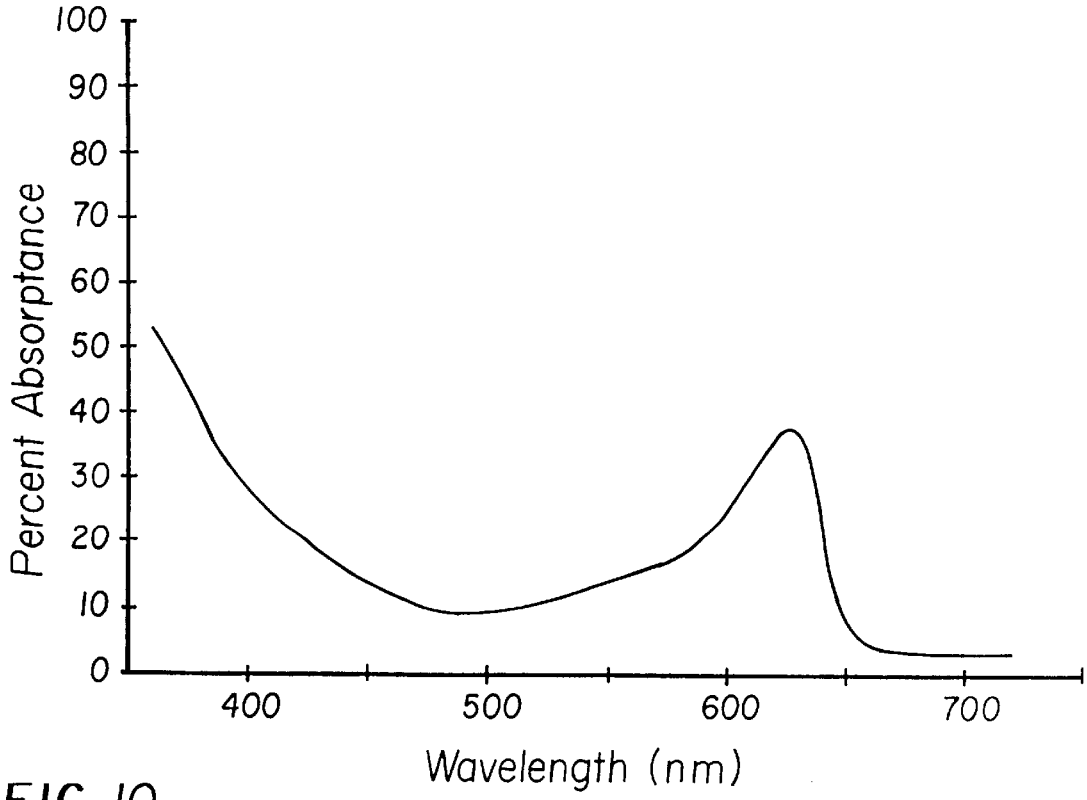
Figure 11:
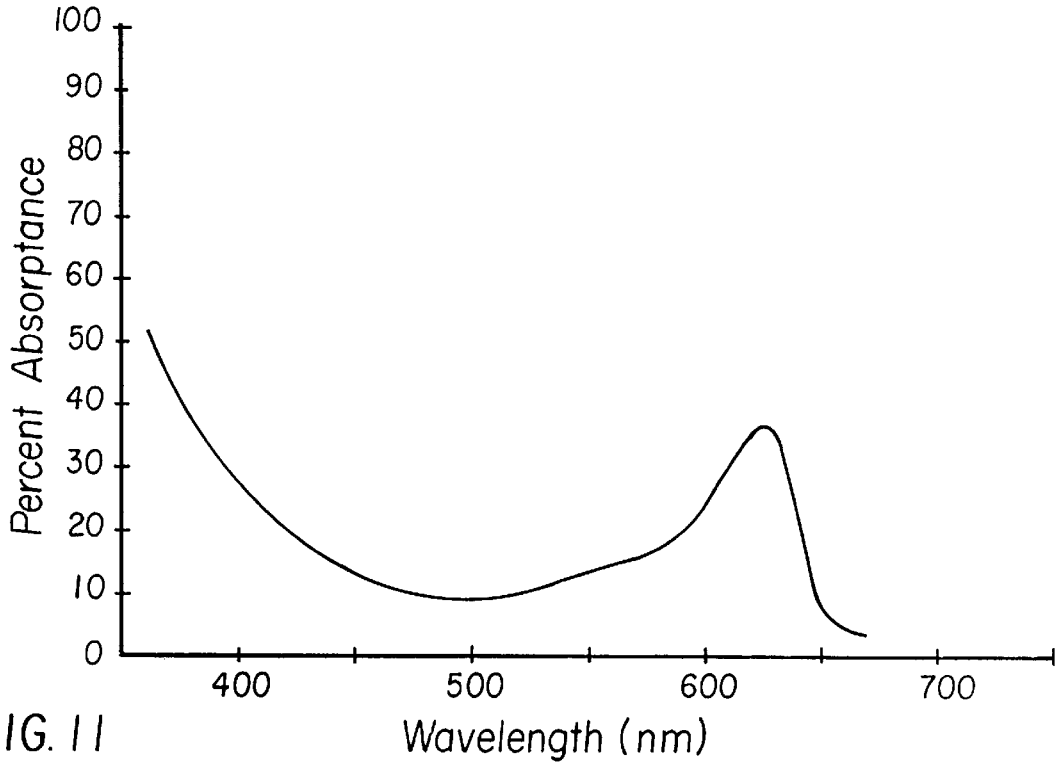

The chemically and spectrally sensitized emulsions were then coated and analyzed as in examples 3 and 4. The results are shown in FIGS. 9–11. Again separate addition of the dyes in sample 5-1 does not give a co-aggregate, but a squared off peak (FIG. 9). Simultaneous addition of the dyes by melting together separate dispersions (sample 5-2) or, more preferably, co-dispersing the dyes (sample 5-3), gives equivalent aggregation of the dyes as shown in FIGS. 10 and 11, respectively.

EXAMPLE 6

SPECTRAL SENSITIZATION OF A TABULAR EMULSION

Another iodobromide tabular emulsion was given a similar finish to that in Example 3 using a co-dispersion of dye 1 and dye 3 in a 1:2 molar ratio. Sample 6-1 was done on a scale of 0.3 moles of silver. Samples 6-2 and 6-3 were generated by repeating the finish at a scale of 6 moles and 100 moles, respectively. Coatings were made of the emulsions and analyzed as in Example 3. The results are given in Table II.

TABLE II

| Sample | Scale | Aggregate Peak | Halfbandwidth |
|---|---|---|---|
| 6-1 | 0.3 mole | 625.6 mn | 54 nm |
| 6-2 | 6 moles | 625.1 mn | 54 nm |
| 6-3 | 100 moles | 625.6 | 53 nm |

This data shows that using a co-dispersion as the method for simultaneous addition of the dyes produces an aggregation state on the surface of the silver halide emulsion that is very reproducible with respect to the quantity of emulsion that is being sensitized. Coated samples of these emulsions also had nearly identical photographic performance.

EXAMPLE 7

SPECTRAL SENSITIZATION OF A TABULAR EMULSION

Another sample of the emulsion of Example 6 was dyed using either the non-gel dispersion of Example 2 or a gelatin co-dispersion of dyes 1 and 3 as prepared in Example 1. The two dispersions gave identical light absorption spectra and photographic performance.

The invention has been described in detail with particular reference to preferred embodiments, but it will be understood that variations and modifications can be effected within the spirit and scope of the invention.

What is claimed is:

1. A method of sensitizing an aqueous silver halide emulsion comprising the steps of:

a) forming a co-dispersion of a first sensitizing dye and a second sensitizing dye in an aqueous medium, in the absence of an organic solvent, wherein the peak absorptance of the second dye is at least 10 nm different from the peak absorptance of the first dye, and wherein the ratio of the first dye to the second dye is about 10:1 to 1:20; and b) incorporating the resulting co-dispersion in an aqueous silver halide emulsion;

wherein each of the dyes is a J-aggregating dye and the dyes co-aggregate when incorporated into the silver halide emulsion to give a single intermediate peak absorptance.

2. A method in accordance with claim 1, wherein the co-dispersion is formed by adding the sensitizing dyes to an aqueous medium with agitation at a temperature of from about 20 to 50° C. and continuing agitation for from about 30 minutes to about 5 hours.

3. A method in accordance with claim 1, wherein the co-dispersion is formed by mixing an aqueous dispersion of the first dye with an aqueous dispersion of the second dye.

4. A method in accordance with claim 3, wherein each of the dyes is a red sensitive dye.

5. A method in accordance with claim 3, wherein each of the dyes is represented by formula I:

(I)

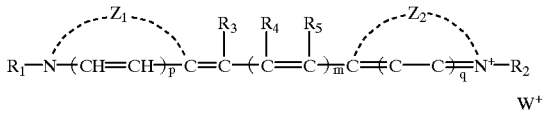

where $Z_1$ and $Z_2$ represent the atoms necessary to form a substituted or unsubstituted hetero ring and may be the same or different, m, p, and q may be 0 or 1, $R_1$ and $R_2$ are acid solubilizing groups, $R_3$, $R_4$, and $R_5$ are each hydrogen or 1–4 carbon alkyl groups and $W^+$ is a counterion as needed to balance the charge.

6. A method in accordance with claim 5, wherein the first dye is of the structural formula:

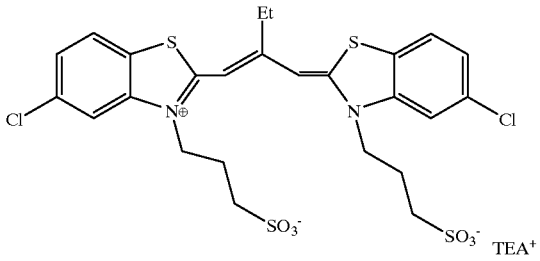

and the second dye is of the structural formula:

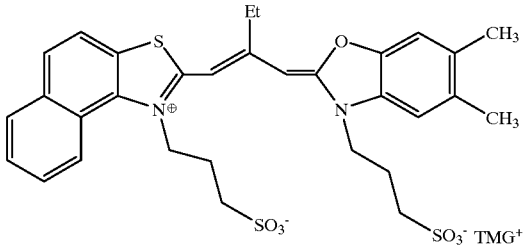

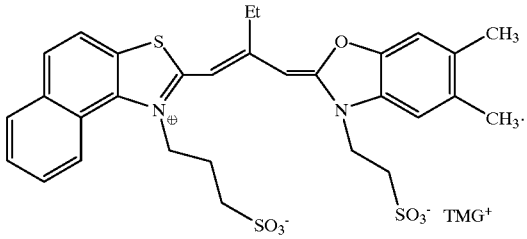

7. A method in accordance with claim 1, wherein the aqueous medium comprises water and a hydrophilic colloid.

8. A method in accordance with claim 7 wherein the hydrophilic colloid is gelatin.

9. A method of manufacturing a photographic element which comprises coating onto a photographic support a sensitized silver halide emulsion prepared in accordance with the method of claim 1.

10. A method in accordance with claim 9, wherein the photographic element is a color photographic element.

11. A method according to claim 9, wherein the sensitized silver halide emulsion is sensitive to red light.

* * * * *